US006571500B2

(12) United States Patent
Keenan et al.

(10) Patent No.: US 6,571,500 B2
(45) Date of Patent: Jun. 3, 2003

(54) DRY-FIRE TRAINING PISTOL

(76) Inventors: Terence J. Keenan, 11069 Cedar Creek Dr., Alta Loma, CA (US) 91737; Vicki L. Keenan, 11069 Cedar Creek Dr., Alta Loma, CA (US) 91737

( * ) Notice: Subject to any disclaimer, the term of this patent is extended or adjusted under 35 U.S.C. 154(b) by 0 days.

(21) Appl. No.: 09/973,830

(22) Filed: Oct. 11, 2001

(65) Prior Publication Data

US 2002/0100201 A1 Aug. 1, 2002

Related U.S. Application Data

(60) Provisional application No. 60/248,222, filed on Nov. 15, 2000.

(51) Int. Cl.[7] ..... F41C 33/00; F41C 33/06

(52) U.S. Cl. ..... 42/54; 434/16

(58) Field of Search ..... 42/54, 71.02, 84; 434/16–19

(56) References Cited

U.S. PATENT DOCUMENTS 2,405,308 A * 8/1946 Jack
3,128,570 A * 4/1964 Browning
3,217,441 A * 11/1965 Kerr
3,724,112 A * 4/1973 Bullis et al.
4,501,081 A * 2/1985 Izumi
5,233,776 A * 8/1993 Hessey
5,244,431 A * 9/1993 D'Andrade
5,357,703 A * 10/1994 Chestnut et al.
5,621,997 A * 4/1997 Pearce
5,842,300 A * 12/1998 Cheshelski et al.
5,950,344 A * 9/1999 Ross
6,260,301 B1 * 7/2001 Aigner et al.
6,354,033 B1 * 3/2002 Findley

* cited by examiner

*Primary Examiner*—Charles T. Jordan
*Assistant Examiner*—Troy Chambers
(74) *Attorney, Agent, or Firm*—Pro Per

(57) ABSTRACT

A handheld training pistol specifically designed to train the user to anticipate the transition from double-action to single-action experienced when shooting most semi-automatic pistols. The training pistol includes a blocking bar (19) that prevents full forward movement of the reset mechanism, causing the training pistol to simulate a single-action trigger pull. The training pistol further includes a decocking system that allows the user to transition the training pistol back to the double-action or starting position. The training pistol is made of some type of brightly colored plastic with weighted inserts to provide a realistic training device.

4 Claims, 9 Drawing Sheets

RIGHT SIDE HOUSING

RIGHT SIDE HOUSING
ANGLED VIEW

TRIGGER

TRIGGER
ANGLED VIEW

SNAPPER

SNAPPER
ANGLED VIEW

BLOCKING BAR

BLOCKING BAR
RIGHT SIDE
ANGLED VIEW

DECOCKING LEVER ASSEMBLY

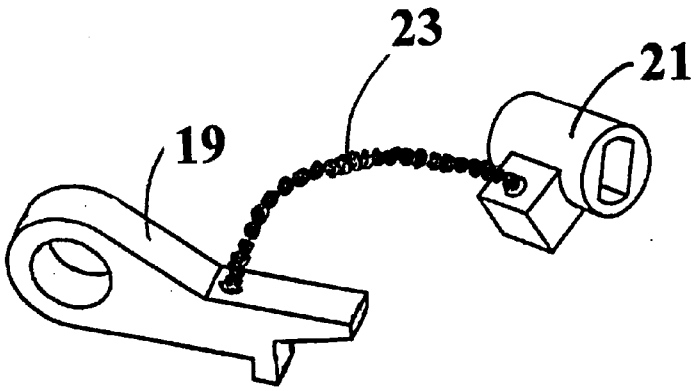
Fig. 6 DECOCKING LEVER TO BLOCKING BAR CONNECTION
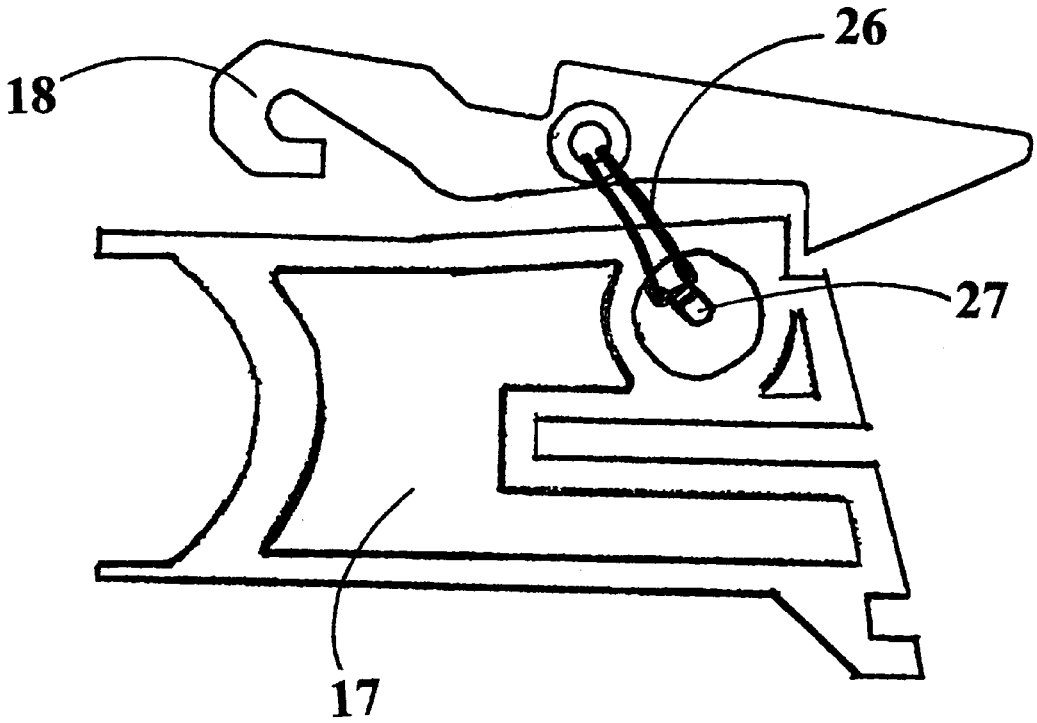
FIG. 7 SNAPPER TO TRIGGER CONNECTION

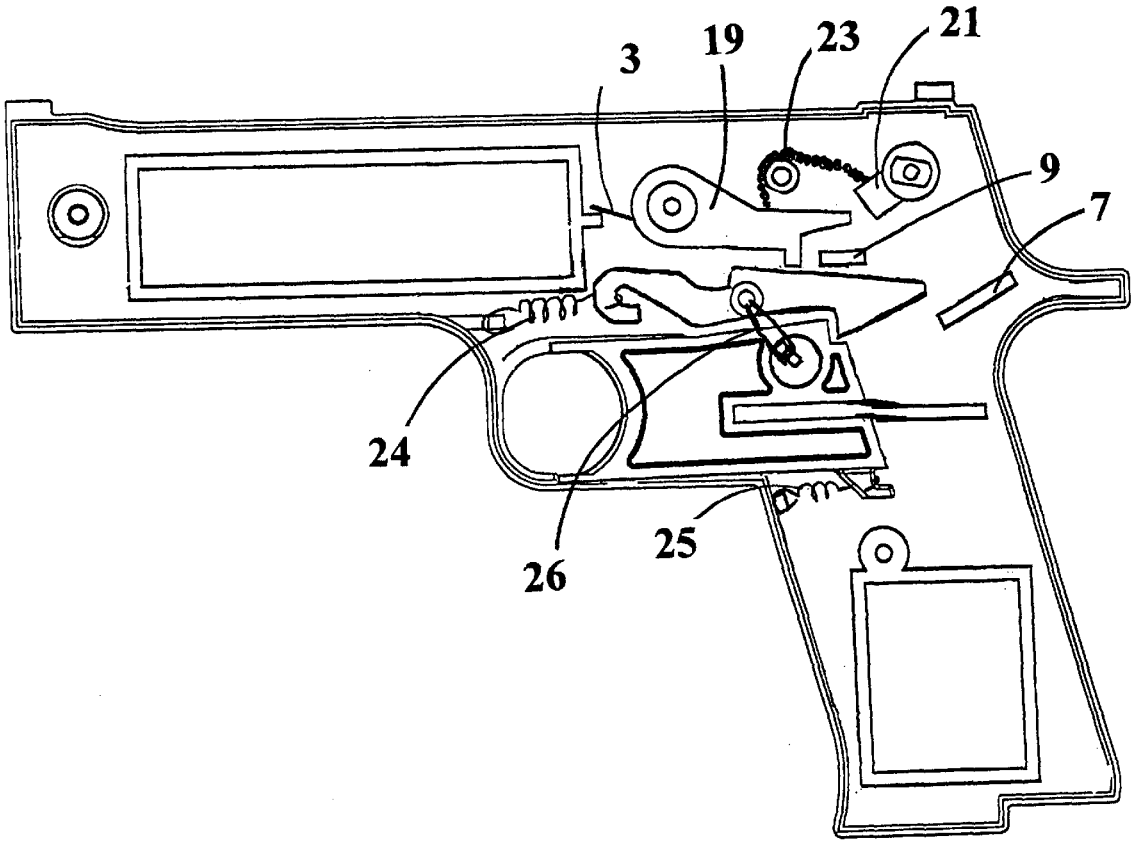
FIG. 8 COMPLETE ASSEMBLY IN DOUBLE ACTION OR STARTING POSITION

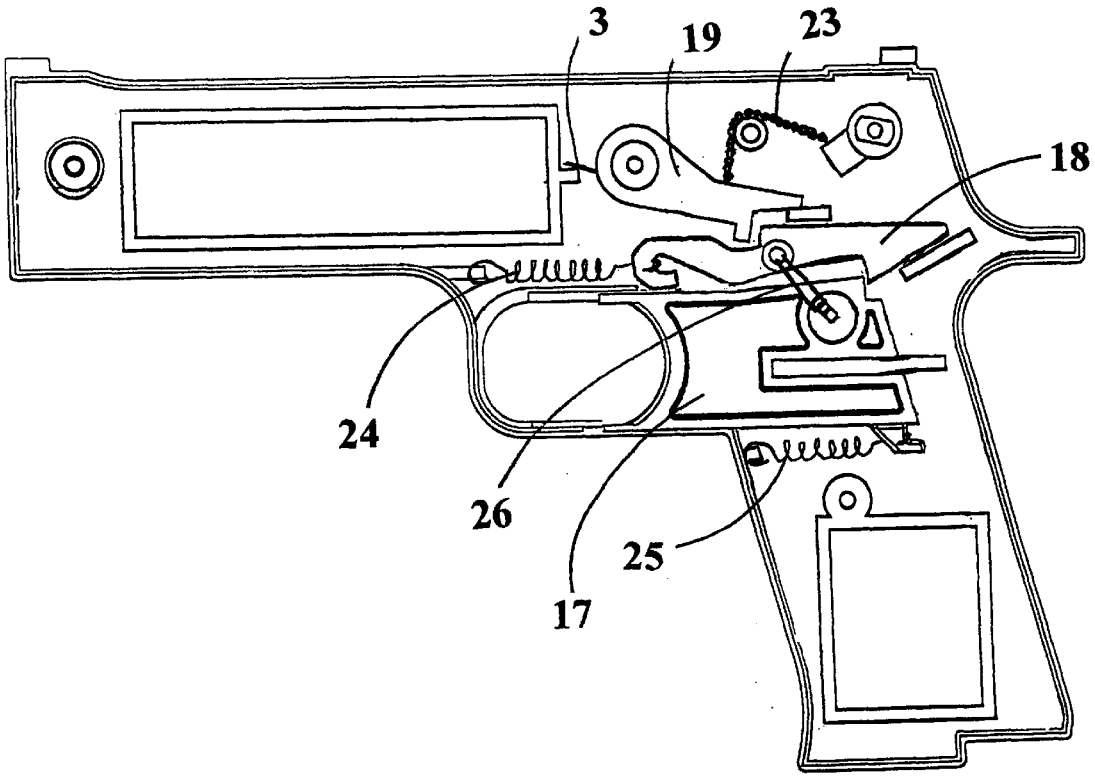
FIG. 9 COMPLETE ASSEMBLY IN SINGLE-ACTION POSITION

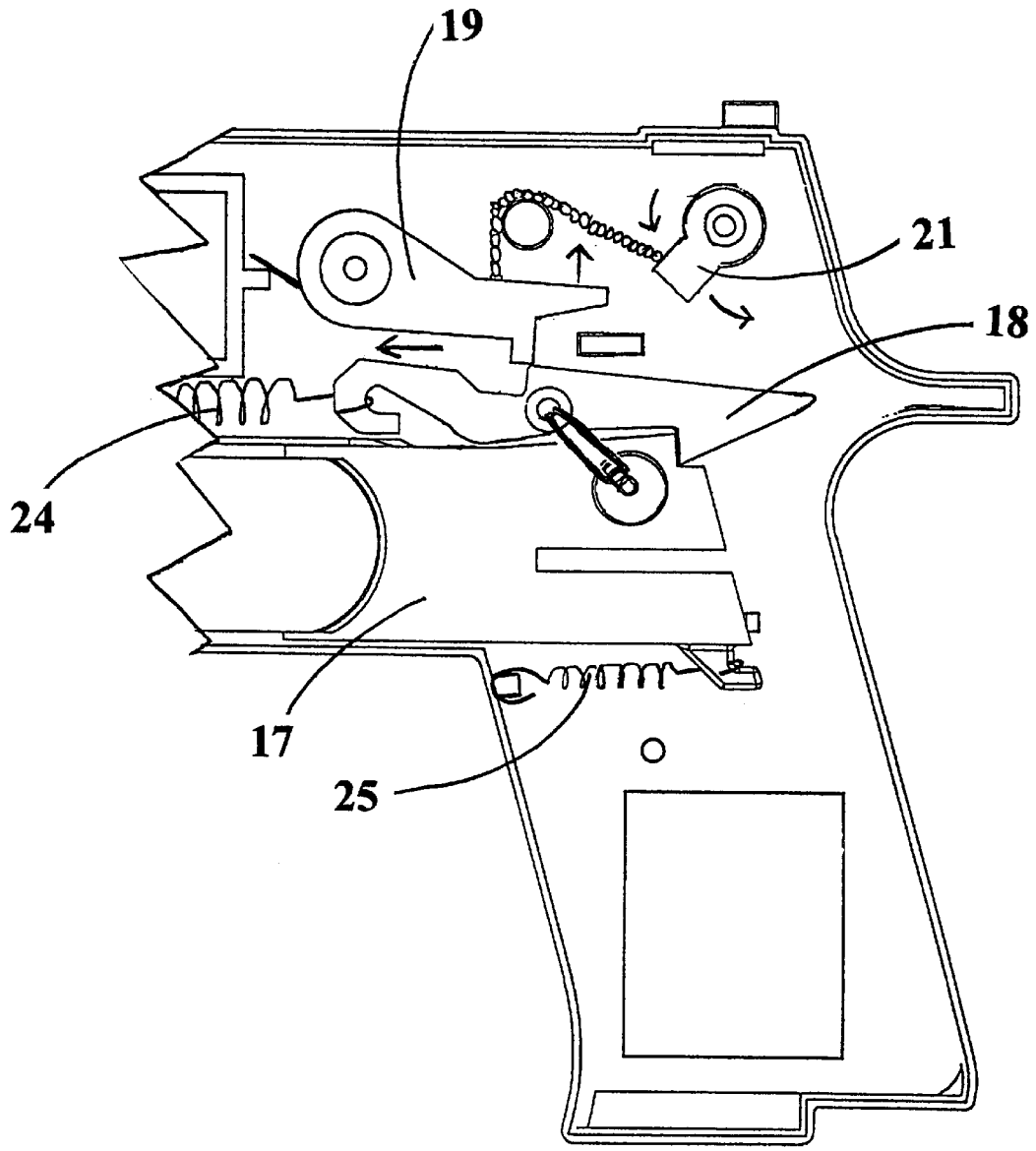
FIG. 10 ILLUSTRATION OF MOVEMENT BACK TO DOUBLE-ACTION POSITION

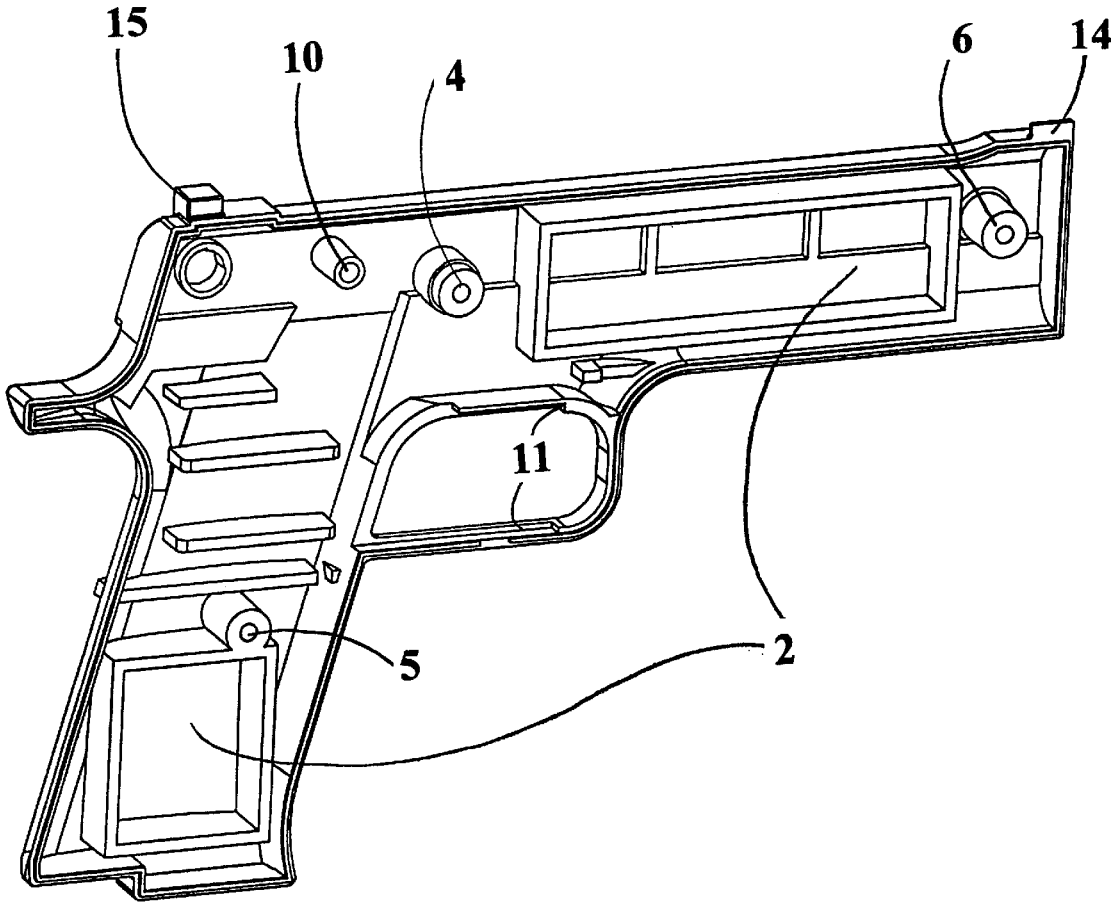
Fig. 11 LEFT SIDE HOUSING
ANGLED VIEW

DRY-FIRE TRAINING PISTOL

CROSS-REFERENCE TO RELATED APPLICATIONS

This application is entitled to the benefit of Provisional Patent Application Ser. No. 60/248,222, filed Nov. 15, 2000

BACKGROUND

1. Field of Invention

This invention relates to safer firearms training, specifically for shooters to develop the correct muscle memory to anticipate the transition from double-action to single-action experienced when shooting most semi-automatic firearms.

2. Description of Prior Art

As long as there have been firearms, shooters have been searching the best way to increase their accuracy in using them. For Law Enforcement Officers, their lives could depend on their ability to quickly hit their target with speed and accuracy. The simplest and most cost effective method has always been to "Dry-fire," or practice shooting with an unloaded gun. The user simply chooses a suitable target, holds the firearm in a standard shooting position, lines up the front and rear sights, and practices pulling the trigger while keeping the sights fixed on the previously chosen target. This helps develop the correct hand and eye coordination, as well as the muscle memory to correctly pull the trigger smoothly rearward while keeping the sights fixed on the target. All of this greatly benefits the shooter when actually loading and firing the weapon.

Among the problems related to dry firing is the damage it does to the firing pin on expensive firearms. Continually pulling the trigger and allowing the firing pin to slam into an empty chamber will eventually cause it to malfunction when the shooter needs it most.

Another problem when dry-firing using an unloaded semi-automatic pistol, is that the pistol will not reset the itself into single-action after the first trigger pull, the way it does when a bullet is fired from it. It remains in double-action after each trigger pull, causing the user to develop the incorrect muscle memory. The user will become used to a complete release of the trigger each time. When the user then actually fires his loaded semi-automatic pistol, the pistol resets into single-action, or "cocks" itself after the first trigger pull as it loads the next bullet into the chamber. The shooter who has dry fired repeatedly in double-action and developed the incorrect muscle memory will pull too far and too hard against very little resistance, causing the gun barrel to move and the sights to become misaligned. The bullet will then miss it's target.

Based upon the patent search and research conducted, there is no other product or invention, patented or otherwise, that has been developed to allow shooters to safely dry fire without the use of an actual unloaded firearm. There has more certainly been no other product that allows the user to build the correct muscle memory to anticipate the trigger transition from double-action to single-action when firing a semi-automatic handgun.

SUMMARY

The present invention is a handheld training pistol that will simulate the trigger transition from double-action to single-action, experienced when firing an actual semi-automatic pistol.

Objects and Advantages

In addition to the objects and advantages previously described, several objects and advantages are:

(a) to provide safe, inexpensive shooting training that can be conducting in the user's own home. The present invention fires no projectile so there is no danger of damage or injury to anyone;

(b) to allow dry firing without the inherent dangers of unloading and reloading firearms in the home;

(c) to cause the user to develop the muscle memory to anticipate the transition from double-action to single-action;

(d) to save the user the danger and cost of using live ammunition, while allowing for quality shooting training;

(e) to allow the user to stop damaging expensive firearms in order to improve shooting accuracy;

While the present invention is made to be the basic size and shape of a standard six-inch semi-automatic pistol, it is constructed from a brightly colored plastic to prevent it from ever being mistaken for an actual firearm This is an important aspect of the invention as it further provides the safest firearms training possible.

The invention further contains two cavities, which will be filled with lead, or some other heavy material in order to provide the user with the approximate weight of an average firearm. Again this is done to provide the safest, most realistic training possible.

DRAWING FIGURES

In the drawings, the same number with an alphabetic suffix depicts the same component from a different angle.

FIGS. 1 and 1*a* show the right side housing void of any internal pieces except the torsion spring, which is clearly shown here and primarily hidden in other views.

FIGS. 2 and 2*a* show isolated views of the trigger.

FIGS. 3 and 3*a* show isolated views of the snapper.

FIGS. 4 and 4*a* show isolated views of the blocking bar.

FIG. 6 shows the blocking bar and decocker connection by means of a ball chain.

FIG. 7 shows an enlarged view of the snapper and the connection to the trigger by means of a rubber band.

FIGS. 8 through 10 show the movement of the internal pieces as the trigger on the training pistol is pulled, set into single-action and returned back to double-action FIG. 11 shows the left side housing void of any internal pieces.

REFERENCE NUMBERS IN DRAWINGS

| Reference Numbers in Drawings |
|---|
| 1 right side housing |
| 2 lead cavities |
| 3 torsion spring |
| 4 blocking bar lug |
| 5 grip mounting lug |
| 6 front mounting lug |
| 7 snapper ramp |
| 8 trigger guide |
| 9 blocking bar stop |
| 10 ball chain post |
| 11 trigger grooves |
| 12 main spring post |
| 13 return spring post |

-continued

| Reference Numbers in Drawings |
|---|
| 14 front sight |
| 15 rear sight |
| 16 decocking lever hole |
| 17 trigger |
| 18 snapper |
| 19 blocking bar |
| 20 right decocking lever |
| 21 decocker |
| 22 left decocking lever |
| 23 ball chain |
| 24 main spring |
| 25 return spring |
| 26 rubber band |
| 27 trigger post |
| 28 rubber band hole |
| 29 torsion spring ledge |
| 30 trigger guard |

DESCRIPTION—FIGS. 1 THROUGH 11

Figure 1:
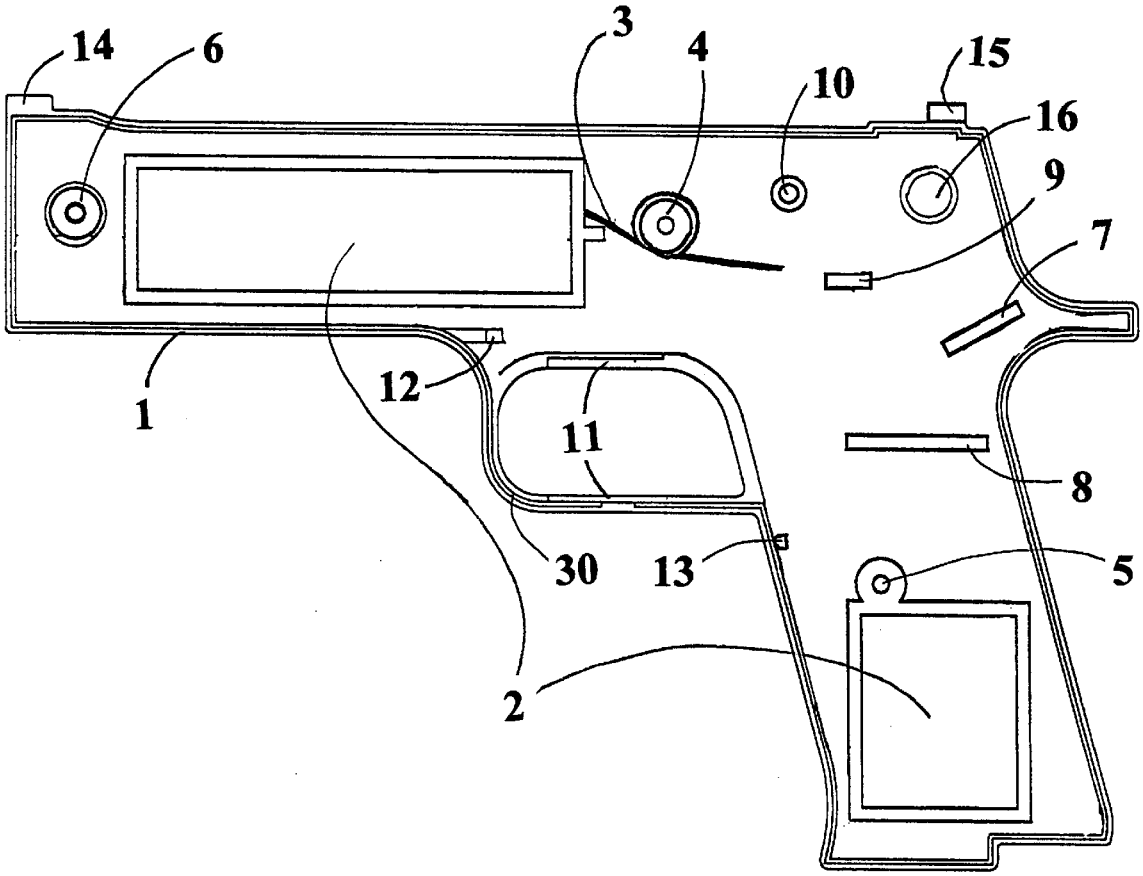
Figure 2:
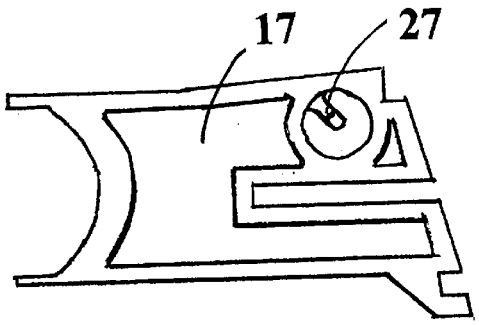
Figure 2A:
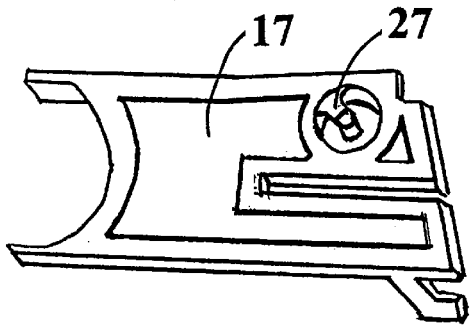
Figure 3:
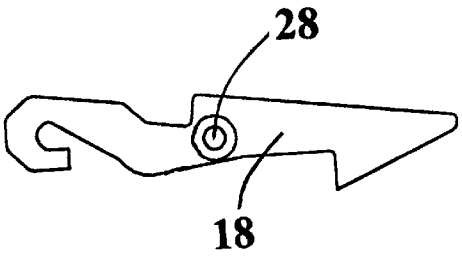
Figure 3A:
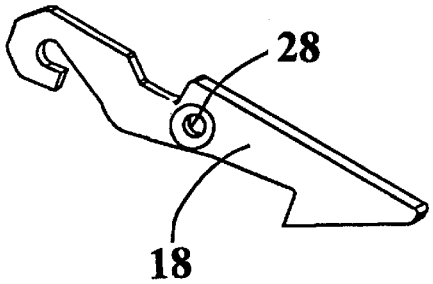
Figure 4:
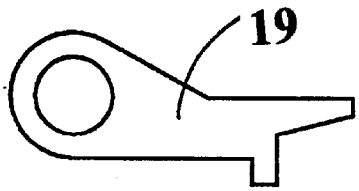
Figure 4A:
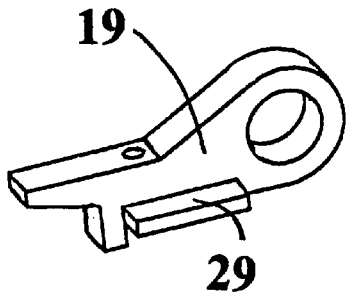

The majority of this handheld training pistol is constructed of brightly colored plastic except when otherwise noted, such as the lead inserts, rubber band 26, ball chain 23 or springs 3, 24, 25. Molded into the right side housing 1 (FIGS. 1–2) are the majority of accessories needed to complete assembly. Along the forward or barrel section and in the lower or grip section are rectangular cavities 2 that will contain lead or some other high density material, to add weight to the training pistol which will provide a realistic feel.

The trigger 17 to the pistol is inserted along the trigger grooves 11 and trigger guide 8. This combination will keep the trigger 17 in place as it is pulled rearward against the forward pressure caused by the main spring 24 and return spring 25. The snapper 18 is affixed to the top of the trigger 17 by means of the rubber band 26. The rubber band 26 is first hooked over the trigger post 27, then pushed through the rubber band hole 28 in the snapper 18, and again hooked over the trigger post 27 in the opposite direction (FIG. 7). This will keep moderate pressure between the snapper 18 and trigger 17 causing the pistol to reset itself after each trigger pull.

The main spring 24 is affixed to the right side housing 1 on the main spring post 12 located above the front of the trigger grooves 11. The opposite end of the main spring 24 is attached to the front of the snapper 18. This will cause the snapper 18 to move forward each time it moves upward on the snapper ramp 7 sufficiently enough to lose contact with the trigger 17. The length of the main spring 24 is sufficient that when it is completely constricted, the trigger 17 will be able to move forward past the rear of the snapper 18 allowing the snapper to move downward and rest the pistol.

The trigger 17 is caused to move forward by the return spring 25. The return spring 25 is affixed to the right side housing 1 at the return spring post 13 located under the rear of the trigger grooves 11. The return spring 25 will cause continuous moderate pressure on the trigger 17, even as the blocking bar 19 interrupts the pressure from the main spring 24.

The blocking bar 19 is a lever located just above the snapper 18, which is attached to the right and left side housing 1 at the blocking bar mounting lug 4 and rotates slightly as it is forced downward by means of a torsion spring 3 connected to the torsion spring ledge 29 on the rear of the blocking bar 19. This rotational movement is depicted in FIGS. 8 and 9, as clockwise. The blocking bar 19 can be rotated upward or counterclockwise by means of rotating the decocker 21 counterclockwise thereby pulling the ball chain 23 downward, conversely providing lift to the blocking bar 19 (FIG. 10).

Figure 1A:
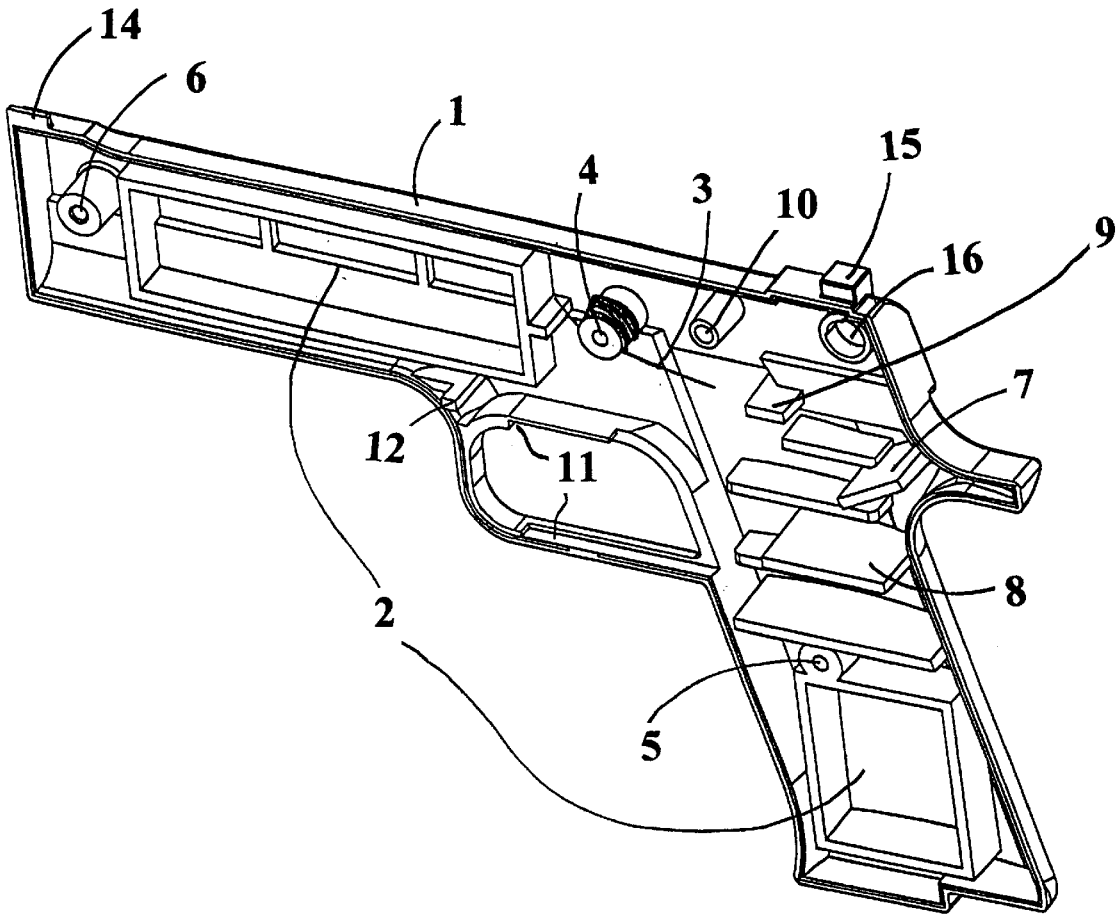

FIG. 8 illustrates the training pistol in the staring or double-action position. As the trigger 17 on the training pistol is pulled rearward, the connection between the trigger 17 and the snapper 18 will cause the snapper 18 to glide rearward, and the main spring 24 to expand. The snapper 18 will continue to glide rearward as it makes contact with the snapper ramp 7 and begins to slide upward and rearward along same. At one point, however, the snapper ramp 7 will cause the snapper 18 to rise sufficiently to cause it to lose contact with the rear portion of the trigger 17. It is at this point that the main spring 24 will constrict and pull the snapper 18 forward, releasing the trigger resistance caused by the main spring 24 and giving the user the sensation that a shot has been fired. It is then that the blocking bar 19, which is under slight but constant clockwise pressure from the torsion spring 3 that contacts with both the blocking bar 19 and right side housing 1 (FIGS. 1, 1*a*, and 8), will rotate downward into the notch molded into the top of the snapper 18, preventing it from full forward movement (FIG. 9). Since the trigger 17 is free to move completely forward, but when moving rearward will not encounter the resistance provided by the snapper 18 and main spring 24 until the trigger pull is nearly complete, this position provides the user with the sensation of a single-action or "cocked" pistol The training pistol will reset itself in this position after each successive trigger pull until the blocking bar 19 is pulled upward allowing the main spring 24 to fully constrict and pull the snapper 18 to it's most forward position (FIG. 10). In order to accomplish this, the decocker 21 must be utilized.

Figure 5:
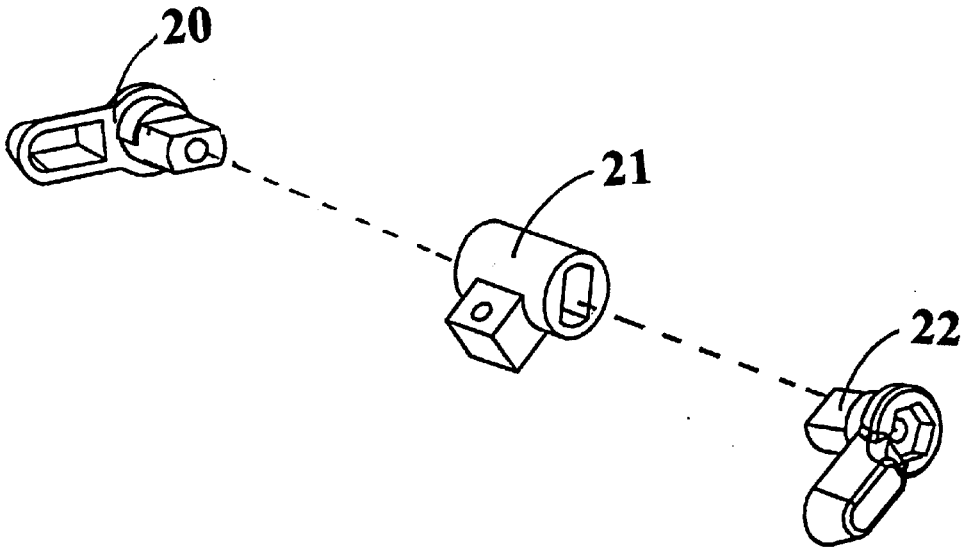
FIG. 5 shows the decocker assembly and the way the components fit together.

There is a rectangular slot molded throughout the center of the decocker 21. The left and right decocking levers 20, 22 are pushed into their respective decocking lever holes 16 molded into the left and right housing cavities 1 and are then inserted into these slots (FIG. 5). These decocking levers 20, 22 allow the user to rotate the decocker 21 downward and upward from the outside of the left and right housing cavity 1. The decocker 21 is connected to the blocking bar 19 by means of a ball chain 23 inserted through small holes molded into each of them (FIG. 6). This ball chain 23 is then looped over the ball chain post 10 molded into both the left and right side housings 1 shown in FIGS. 8–10. This will cause the ball chain 23 to lift the blocking bar 19 as the decocker 21 is rotated downward. As the blocking bar 19 is pulled upward, it will lose contact with the notch on the top of the snapper 18, and the pressure from the main spring 24 will pull the snapper 18 forward and reset the training pistol in its original or double-action position. The user would then rotate one of the decocking levers 20, 22, and therefore the decocker 21, back upward, releasing the upward pull on the ball chain 23, and allowing the torsion spring 1 to rotate the blocking bar 19 downward finally resting on top of the flat portion of the snapper 18. This would complete the transition back to the starting or double-action position.

Molded into the right side housing below and rearward of the ball chain post 10, there is a small flat ledge known as the blocking bar stop 9. This is to prevent the blocking bar 19 from causing too much downward pressure on the snapper 18 and preventing it from rising sufficiently to lose contact with the trigger 17. If this occurs, the training pistol will not give the user the sensation that the pistol has been fired.

Once the interior components have been installed, the left side housing is placed symmetrically against the right side housing 1. The left decocking lever 22 is inserted through the decocking lever hole 16 and into the rectangular slot in the decocker 21.

The left side housing is then secured to the right side housing 1 by inserting screws or some type of fastener through the three mounting lugs molded into the left side housing and into the corresponding front, grip, and blocking bar mounting lugs 4, 5, 6 molded into the right side housing 1.

We claim:

1. A simulated training firearm capable of operating in both double and single action modes, the firearm comprising:

a housing having a barrel section and a handle section;

hollow cavities formed in each of said housing and barrel sections;

a trigger connected to said housing and slidingly mounted thereing;

a snapper springingly engaged, in tension, with said housing; and a blocking bar pivotally mounted to said housing;

wherein the snapper is opposingly engaged with said trigger during an initial pull of the trigger, thus simulating the double action mode and wherein the snapper is released from the trigger near the end of the trigger travel and is prevented from further engagement by contact with the blocking bar thus simulating the single action mode.

2. The firearm of claim 1, wherein the housing is made of plastic.

3. The firearm of claim 1, wherein the cavities contain material to simulate a feel of weight.

4. The firearm of claim 1, further including a de-cocker connected to said blocking bar wherein activation of said de-cocker operates to dis-engage the blocking bar from said snapper thereby resetting said firearm back to double action mode.

* * * * *